US005297573A

United States Patent [19]

Jacobsson

[11] Patent Number: 5,297,573

[45] Date of Patent: Mar. 29, 1994

[54] OVERSPEED SAFETY DEVICE

[75] Inventor: Rolf A. Jacobsson, Saltsjö-Boo, Sweden

[73] Assignee: Atlas Copco Tools AB, Nacka, Sweden

[21] Appl. No.: 82,060

[22] Filed: Jun. 23, 1993

[30] Foreign Application Priority Data

Jun. 29, 1992 [SE] Sweden ..... 9201989-2

[51] Int. Cl.[5] ..... F16K 31/50

[52] U.S. Cl. ..... 137/57; 251/74; 251/297

[58] Field of Search ..... 137/57; 251/74, 297

[56] References Cited

U.S. PATENT DOCUMENTS

| | | | |
|---|---|---|---|
| 1,031,294 | 7/1912 | Schutte | 137/57 |
| 1,077,503 | 11/1913 | Anderson | 137/57 |
| 2,209,135 | 7/1940 | Parker | 251/297 |
| 2,569,967 | 10/1951 | Ashton | 251/297 |
| 2,970,607 | 2/1961 | Peck et al. | 251/297 |
| 2,977,931 | 4/1961 | Schott | 415/32 |
| 3,602,479 | 8/1971 | Bowen | 251/74 |
| 3,625,479 | 12/1971 | Hammon | 251/297 |
| 4,928,919 | 5/1990 | Daicho et al. | 251/297 |

FOREIGN PATENT DOCUMENTS 1366482 9/1974 United Kingdom .

*Primary Examiner*—John T. Kwon

*Attorney, Agent, or Firm*—Frishauf, Holtz, Goodman & Woodward

[57] ABSTRACT

An overspeed safety device for a pneumatic rotation motor comprises a housing (10, 18) and a valve element (28) which is located in a bore (27) in the housing (10, 18) and which by a trip device (29, 31) is locked in a normally open position and arranged to block at least the main part of the air supply to the motor when shifted to a closed position, and an activating device (37, 38) coupled to a rotating part (14) of the motor and arranged to be shifted by inertia forces from a normal rest position to an active position at a predetermined motor speed level. The trip device (29, 31) comprises an open spring wire lock ring (29) pretensioned toward a closed condition and located in a groove (30) in the valve element (28), and a holding device (31) normally located between the ends of the lock ring (29) to maintain the lock ring (29) in an expanded condition in which its outer diameter exceeds the inner diameter of a shoulder (32) in the bore (27). At overspeed, the activating device (37, 38) moves the holding device (31) out of its lock ring (29) expanding position, thereby enabling the latter to contract and release the valve element (28) for movement toward a closed position.

7 Claims, 3 Drawing Sheets

OVERSPEED SAFETY DEVICE

BACKGROUND OF THE INVENTION

This invention pertains to an overspeed safety device, particularly to an overspeed safety device for a pneumatic rotation motor, comprising a valve element guidingly supported in a bore in the motor housing and arranged to block at least partly the air supply to the motor when shifted from a normally open position to a closed position. Such device also comprises an activating means coupled to a rotating part of the motor and arranged to be shifted by inertia forces from a normal rest position to an active position at a predetermined motor speed level, and a trip means supporting the valve element in the open position and arranged to be triggered by the activating means.

The main object of the invention is to create an overspeed safety device for a pneumatic motor that is simple and compact in structure yet reliable in operation.

One example of previously known overspeed safety devices of the above type is described in U.S. Pat. No. 2,977,931. In this prior art device a cylindrical valve element is rotatably supported in a bore in the motor housing to control an air inlet passage, and an activating means is arranged to engage and move the valve element to closed position at a predetermined speed level.

A drawback inherent in this known device is the large contact surfaces between the valve element and the housing necessary to guide a rotative element. These surfaces tend to increase the frictional resistance between the valve element and the housing, especially after a long inactive period when corrosive and/or other influence upon the surfaces has taken place.

Another example is shown in G.B. Patent No. 1,366,482 where a valve spindle is arranged to be moved axially by a spring to block an axial air inlet passage when released by a trip means at activation of a fly-weight on the motor rotor.

This known device suffer from the drawback of being able to control just a small inlet area, because an increased area would require a stronger spring to accomplish a closing movement of the valve element against the inlet pressure. A heavier spring load would in turn have a negative influence upon the action of the trip means, or would even make the use of a trip means impossible.

The present invention intends to create an improved overspeed safety device by which the above problems are avoided.

A preferred embodiment of the invention is described below in detail with reference to the accompanying drawings.

DETAILED DESCRIPTION

Figure 1:
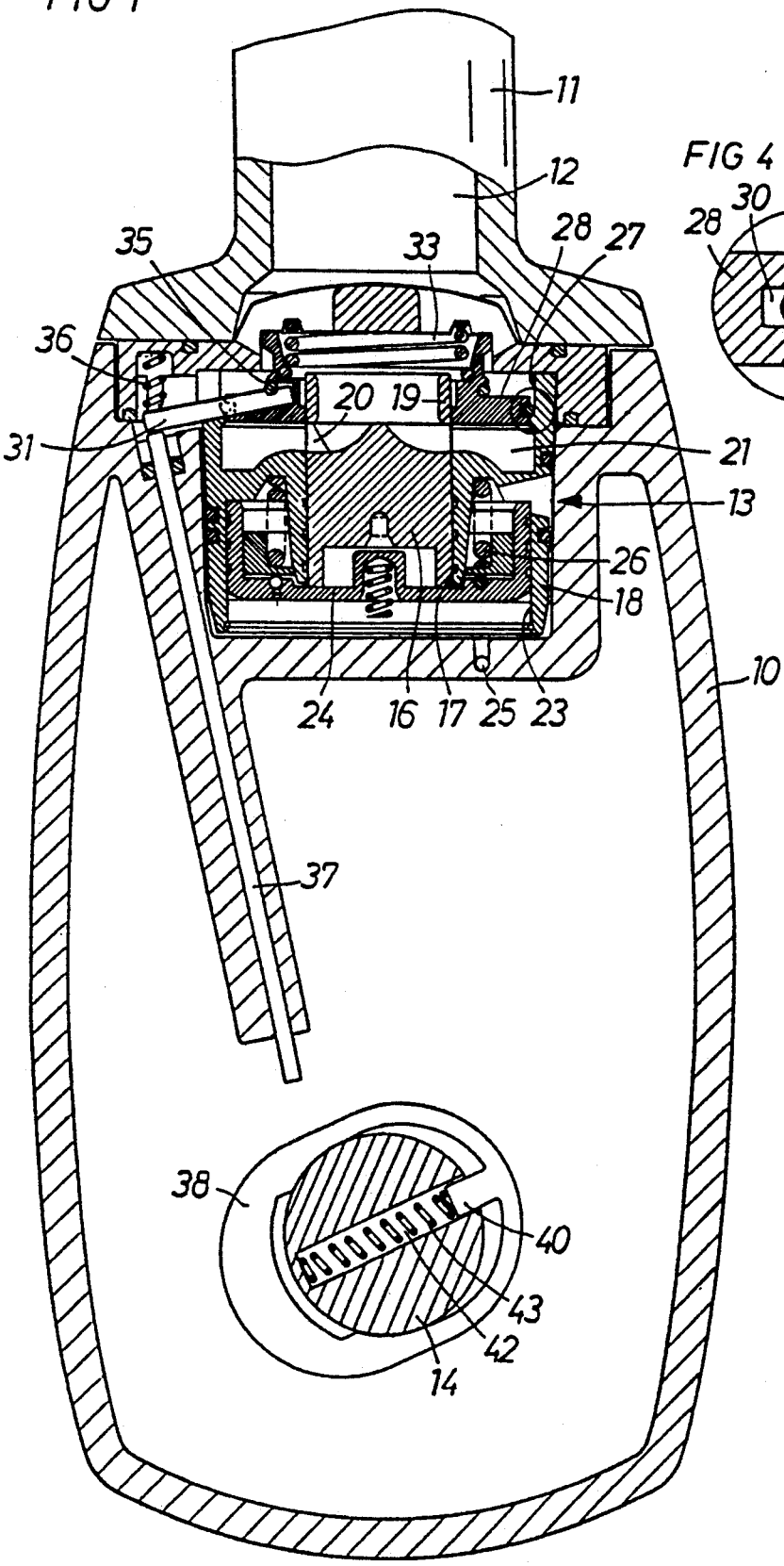
FIG. 1 shows a section through a device according to the invention and illustrates the normal operation condition of the device.

In the drawing figures, an overspeed safety device according to the invention is shown in a grinding tool application.

The illustrated tool comprises a housing 10 with a handle 11, an air inlet passage 12, a speed governor valve unit 13 and a rotation motor (not shown). In this particular embodiment of the invention, an air turbine is used as rotation motor, and the output shaft 14 of the tool is drivingly coupled to the air turbine via a reduction gearing (not shown).

The speed governor valve unit 13 comprises a cylindrical valve member 16 which is movably guided in a bore 17 in a valve housing insert 18. The valve member 16 is formed with a skirt portion 19 and radial openings 20. The latters coincide in the open position of the valve member 16 with an annular chamber 21 which communicates with the air turbine.

In another larger bore 23 in the valve housing insert 18 there is movably guided a control piston 24 acting directly on the valve member 16. This control piston 24 is activated in one direction by a speed responsive control pressure derived from a pressure sensing means in the air turbine and supplied through a passage 25. In the opposite direction, the piston 24 is acted upon by a spring 26 as well as by the air inlet pressure acting on the valve member 16.

The overspeed safety device comprises an annular valve element 28 which surrounds the skirt portion 19 of the valve member 16 and which in its normal open position defines the annular chamber 21 together with the valve housing insert 18. See FIG. 1.

Figure 4:
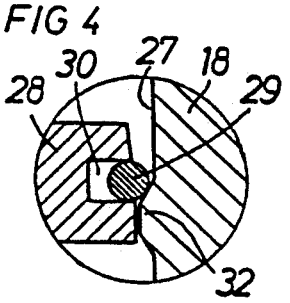
FIG. 4 shows on a larger scale a fractional view of the device in FIG. 1.
Figure 3:
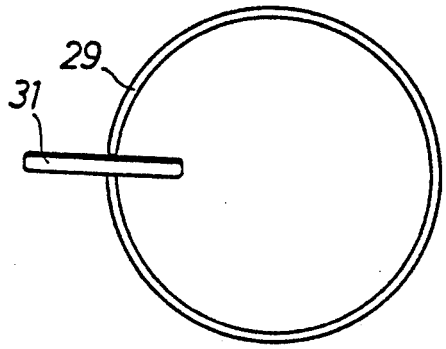
FIG. 3 shows exclusively the trip means of the device in FIG. 1.

The valve element 28 is located in a bore 27 in the valve housing insert 18 and is supported in its normal open position by a trip means formed by a spring wire lock ring 29 partly received in a circumferential groove 30 on the valve element 28. See FIG. 4. The lock ring 29 is open and made maintain an expanded condition by a holding means in the form of a lever 31 located between the ends of the lock ring 29. See FIG. 3. The lock ring 29 is pretensioned toward closed condition.

In its expanded condition, the lock ring 29 has an outer diameter that exceeds the inner diameter of an annular shoulder 32 in the valve housing insert 18, and, thereby, forms an axial lock means for the valve element 28. See FIG. 4. A spring 33 exerts an axial bias load on the valve element 28.

The lever 31 is pivotably supported at its one end on an O-ring 35, and for fixing the lever 31 longitudinally it is formed with an indentation to engage the 0-ring 35. At its opposite end, the lever 31 is acted upon by a compression spring 36, the purpose of which is to bias the lever 31 towards its lock ring 29 expanding position. See FIG. 1.

An activating means in the form of a push rod 37 and a fly-weight 38 mounted on the rear end of the output shaft 14 is intended to release the lock ring 29 by shifting the lever 31 against the action of the spring 36 at a predetermined rotation speed. The fly-weight 38 is annular in shape and has its centre of gravity disposed off the rotation axis of the output shaft 14. The fly-weight 38 is formed with a radial, inwardly directed stud 40 which is received in a diametrical bore 42 in the shaft 14. A spring 43 located in the bore 42 acts on the stud 40 to exert a radial bias force on the fly-weight 38 so as to maintain the latter in its non-activating position at rotation speed levels below the predetermined intended release level of the safety device.

Under normal operating conditions, i.e. when the speed governor operates correctly, the rotation speed of shaft 14 does not reach the level where the inertia force acting on the fly-weight 38 exceeds the bias force of the spring 43. This means that the push rod 37, the lever 31 and the lock ring 29 remain in their normal, inactive positions, and the valve element 28 is supported in its open position. See FIG. 1.

Figure 2:
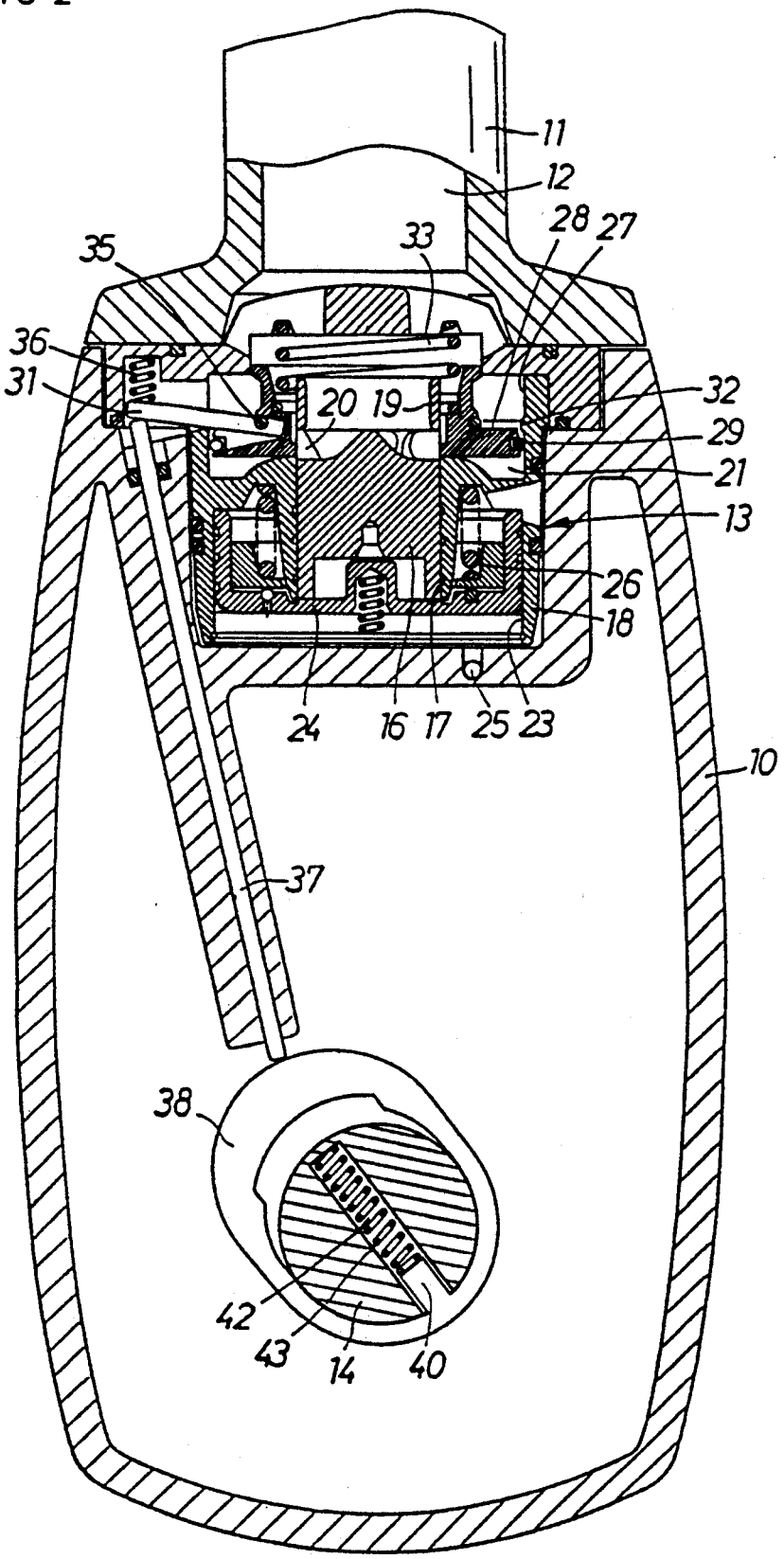
FIG. 2 shows the same section as FIG. 1 but illustrates the device in its released position.

Should, however, the speed governor for some reason malfunction and not be able to limit the rotation speed as intended, the speed will rapidly reach the level where the inertia force acting on the fly-weight 38 exceeds the bias force of the spring 43. Then, the fly-weight 38 is displaced radially to hit the push rod 37 which in turn moves the lever 31 against the action of the spring 36. Thereat, the lever 31 is moved clear of the ends of the lock ring 29, see FIG. 2, which enables the latter to gain its closed, contracted condition. This means that the lock ring 29 retracts into the groove 30 and assumes an outer diameter that is smaller than the inner diameter of the shoulder 32. The valve element 28 is now free to be displaced toward its closed position by the action of the spring 33 and by the air pressure in the inlet passage 12. See FIG. 2.

In its closed position, the valve element 28 covers the radial openings 20 of the speed governor valve member 16, thereby preventing motive pressure air to pass the speed governor valve unit 13 and reach the air turbine.

To reset the overspeed safety device, it is necessary to dismantle the entire mechanism. The trip mechanism is reset by expanding the lock ring 29 by force and place the lever 31 in between the ends thereof to maintain the lock ring 29 in its expanded condition.

The device described above and shown in the drawing figures is applied on an air turbine driven tool. In this application it is easier to obtain a reliable operation of the fly-weight activating means when locating it to the output shaft which is not the rotor of the motor. The very high rotating speed of the turbine rotor would create practical problems for the operation of a fly-weight actuator.

However, it is to be noted that the invention is not at all restricted in its applicability to turbine driven tools, but could as well find its use at vane motor driven tools. In such applications, the fly-weight actuator is mounted on the motor rotor.

The overspeed safety device according to the invention is advantageous in that it is simple and compact in design yet reliable in operation.

I claim:

1. An overspeed safety device for a pneumatic rotation motor, comprising a housing (10, 18) and a valve element (28) guidingly supported in a bore (27) in the housing (10, 18) and arranged to block at least the main part of the air supply to the motor when shifted from a normally open position to a closed position, an activating means coupled to a rotating part (14) of the motor and arranged to be shifted from a normal rest position to an active position at a predetermined motor speed level, and a trip means (29, 31) supporting said valve element (28) in said open position and arranged to be triggered by said activating means (37, 38) to thereby release said valve element (28) for movement toward said closed position, wherein said trip means (29, 31) comprises:

an open spring wire lock ring (29) pretensioned toward a closed condition and located in a groove (30) in said valve element (28), a shoulder (32) in said bore (23) having an inner diameter that is larger than the outer diameter of said lock ring (29) as said lock ring (29) occupies its closed condition, and a holding means (31) normally located between ends of said lock ring (29) so as to maintain said lock ring (29) in an expanded condition in which an outer diameter of said lock ring (29) exceeds an inner diameter of said shoulder (32), thereby supporting the valve element (28) in said open position.

2. The device according to claim 1, wherein said holding means (31) comprises a lever pivotally supported in the housing (10, 18).

3. The device according to claim 1, applied in combination with a speed governor valve unit (13) including at least one air feed opening (20) and a valve member (16) movable to control said at least one air feed opening (20), wherein said valve element (28) is arranged to block said at least one air feed opening (20) in its closed position.

4. The device according to claim 2, wherein said activating means comprises:

a centrifugally operated activator (38) mounted on said rotating part (14) of the motor, and a push rod (37) which at one end thereof engages said lever (31) and which at another end thereof is to be engaged by said activator (38).

5. The device according to claim 2, applied in combination with a speed governor valve unit (13) including at least one air feed opening (20) and a valve member (16) movable to control said at least one or more air feed opening (20), wherein said valve element (28) is arranged to block said at least one air feed opening (20) in its closed position.

6. The device according to claim 3, wherein said activating means comprises:

a centrifugally operated activator (38) mounted on said rotating part (14) of the motor, and a push rod (37) which at one end thereof engages said lever (31) and which at another end thereof is to be engaged by said activator (38).

7. The device according to claim 5, wherein said activating means comprises:

a centrifugally operated activator (38) mounted on said rotating part (14) of the motor, and a push rod (37) which at one end thereof engages said lever (31) and which at another end thereof is to be engaged by said activator (38).

* * * * *